United States Patent [19]

Beroth

[11] 4,400,090

[45] Aug. 23, 1983

[54] CHUGOMETER

[76] Inventor: Wesley H. Beroth, 1351 Bethania-Rural Hall Rd., Winston-Salem, N.C. 27106

[21] Appl. No.: 299,571

[22] Filed: Sep. 4, 1981

[51] Int. Cl.[3] ..... G04F 8/00

[52] U.S. Cl. ..... 368/9; 368/107; 368/120

[58] Field of Search ..... 368/1-4, 368/9, 96, 107, 118, 119, 120, 121, 89, 113; 235/92 T, 92 TA, 92 V, 92 GA; 361/241, 242

[56] References Cited

U.S. PATENT DOCUMENTS 2,351,707 6/1944 Rouprich ..... 368/2

3,648,454 3/1972 Morrison ..... 368/2

4,074,117 2/1978 DeLorean et al. ..... 368/118

*Primary Examiner*—Bernard Roskoski

*Attorney, Agent, or Firm*—D. Paul Weaver

[57] ABSTRACT

Presented hereby is a means for measuring elapsed time commencing with a start signal, after which first and second items may be removed from respective, individual stands for the performance of specific functions and ending with the return of an item to its specific stand. The apparatus comprises a pair of stands for receiving beverage containers in combination with means to optically sense the presence or absence of containers on their stands and light sequence starting means and time recording means responsive to the optical detectors.

11 Claims, 4 Drawing Figures

CHUGOMETER

THE INVENTION

This invention relates to a means to measure the shortest time required to perform two identical functions, each function comprising the acts of removing an item such as a beverage container from a stand, performing work with respect to the item such as drinking the beverage within a container, and returning the container to the stand.

BACKGROUND OF THE INVENTION

Over the years man has developed numerous games of skill, chance and/or dexterity calculated to amuse and entertain observers and participants alike. One such contest is colloquially referred to as a chug-a-lug contest wherein two or more contestants compete to determine who can drink a given quantity of beverage in the shortest time.

Determining the winner of a chug-a-lug or similar contest has been accomplished through the use of referees or observers. The results of contests judged in this manner fail to provide quantitative data which would permit comparison between a plurality of contests. Therefore, this method of judging competitions is extremely limited.

A more comprehensive means of judging chug-a-lug contests has been developed wherein an observer utilizes a stop watch to establish a performance factor for the contest. This system is far superior to the use of an unaided referee but it has numerous shortcomings in that the reaction delays of the person operating the stop watch create measurement errors, the audience is not aware of the real time performance of the competitors and thus audience enthusiasm is lost and most significant, a referee for making judgement calls subject to criticism is required.

OBJECTIVES OF THE INVENTION

In view of the obvious shortcomings of the prior means for evaluating performance during chug-a-lug contests, it is a primary objective of the present invention to provide a means to automatically signal contestants of the approach to the start of a contest, the start of a contest and the performance time of the contest winner.

A further objective of the present invention is to provide a pair of stands for receiving beverage containers in combination with means to determine the presence or absence of containers on stands and an indicating timing means for visually presenting the elapsed time from a start signal until the first beverage container is returned to its stand.

Another objective of the present invention is to provide a chug-a-lug timing device including a Christmas tree style optical starting indicator.

A still further objective of the present invention is to provide a chug-a-lug timing device including a foul indicator activated when a contestant raises a beverage container before the contest is to start.

Another objective of the present invention is to provide a chug-a-lug timing device including a digital elapsed time indicator.

A further objective of the present invention is to provide a chug-a-lug timing device including optical sensing means for providing stop signals to a timing means in response to the return of a beverage container to a stand and for providing an activating signal to a foul indicator when a beverage container is removed from a stand prior to the start of a contest.

The foregoing and other objectives of the present invention will become apparent in light of the drawings, specification and claims contained herein.

SUMMARY OF THE INVENTION

Presented hereby is an electronic timing device for a chug-a-lug contest or similar contest involving the removal of objects from a predetermined position, the performance of a function related to the object or objects after they have been removed and the return of the first object to its associated predetermined position. More specifically, the invention includes first and second beverage container stands each of which incorporate photo-optical means to determine the presence or absence of a container on the stand. The photo-optical sensing means from the stands are logically coupled to a foul indicating circuit along with the output from a Christmas tree or sequential light series starting indicator. If one of the containers is removed before the starting indicator signals Contest Start, the foul indicator is activated. When the starting indicator signals Contest Start, if a foul has not occurred, a digital timer is activated and elapsed time is displayed to the hundredth of a second.

The contest is completed when one of the containers is returned to its original starting position. The timing indicator ceases to count and the total elapsed time is displayed until the system is reset.

DESCRIPTION OF THE INVENTION

Figure 1:
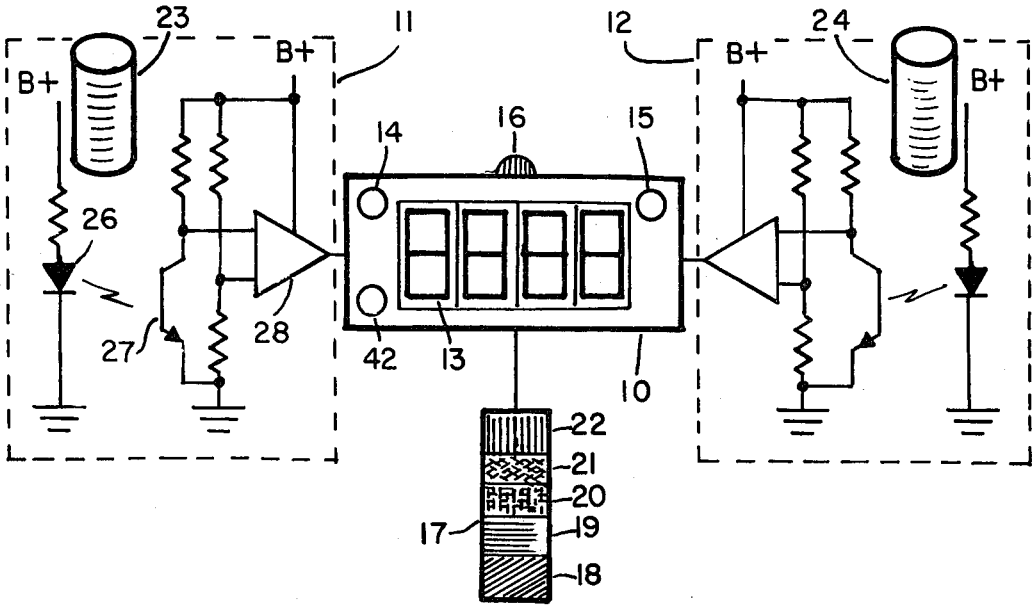
FIG. 1 is a stylized schematic and block diagram of the present invention.

FIG. 1 illustrates a preferred embodiment of the invention arranged to accommodate two contestants. It should be understood that the system may be arranged to accommodate any number of contestants but the discussion presented herein is directed to the two contestant embodiment to simplify the presentation.

In FIG. 1 two identical beverage container stands 11 and 12 are coupled to the control and indicator unit 10. For convenience, the control and indicator unit as illustrated contains the digital timing indicators 13, a reset button 14, a start button 15, and a foul indicator lamp or no chug indicator 16 as well as the timing and control circuits. It should be understood that various other embodiments of the present invention are contemplated wherein circuit, control, and indicator elements are arranged in different chassis.

A Christmas tree starting lamp assembly 17 is coupled to the control and indicator unit 10. The starting indicator includes a plurality of light segments. The first segment, 18, is caused to illuminate when the set button 14 is depressed. This indicates that the various registers of the system have been cleared and prepared for the start of a contest. When the start button is depressed, indicator segments 19, 20, 21 and 22 are sequentially illuminated to indicate to the contestants the approach of the start of the contest. When light segment 22 is illuminated, the timer commences timing and the contest is started.

Beverage container stands 11 and 12 are identical and adapted to receive a beverage container such as containers 23 and 24. To simplify the explanation, beverage container stand 11 will be discussed and it should be understood that the discussion is applicable to beverage container stand 12 and any other beverage container stands that may be included in further embodiments.

Beverage container stand 11 includes a surface upon which container 23 may be placed and a light emitting diode 26 coupled between the system power supply and ground so that when the system is energized, light is radiated from the LED. A photo-transistor 27 is also connected between the power source and ground. Light emitting diode 26 and light responsive transistor 27 are so oriented that light from the diode passes over the surface of the stand that receives the container 23 and impinges on transistor 27. Thus when beverage container 23 is placed on the stand, the light beam from diode 26 is interrupted which results in the input to pin 2 of amplifier 28 being held at a relatively high level. The amplifier is a type LM311 and the high input at pin 2 causes the amplifier output to be high. When beverage container 23 is lifted from the platform, light from diode 26 irradiates light responsive transistor 27 and causes it to conduct. This reduces the pin 2 input of amplifier 28 to a relatively low level and the output goes low.

Figure 2:
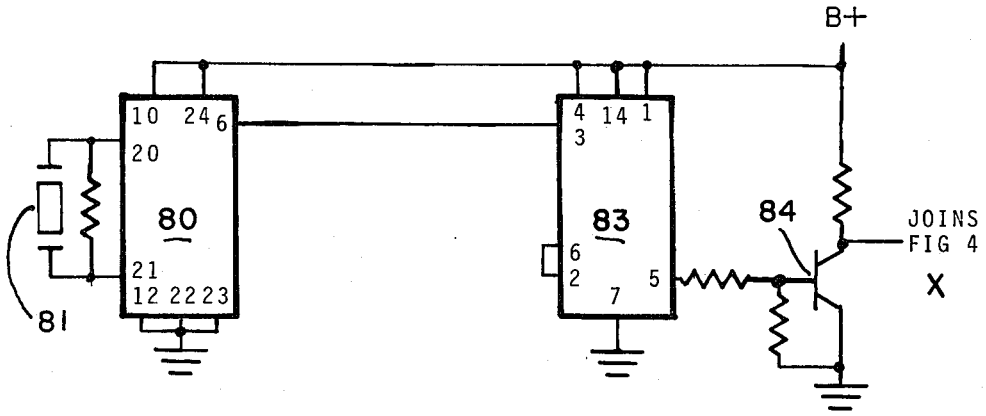
FIG. 2 is a schematic diagram of a preferred clock circuit utilized in the preferred embodiment of the subject invention.
Figure 4:
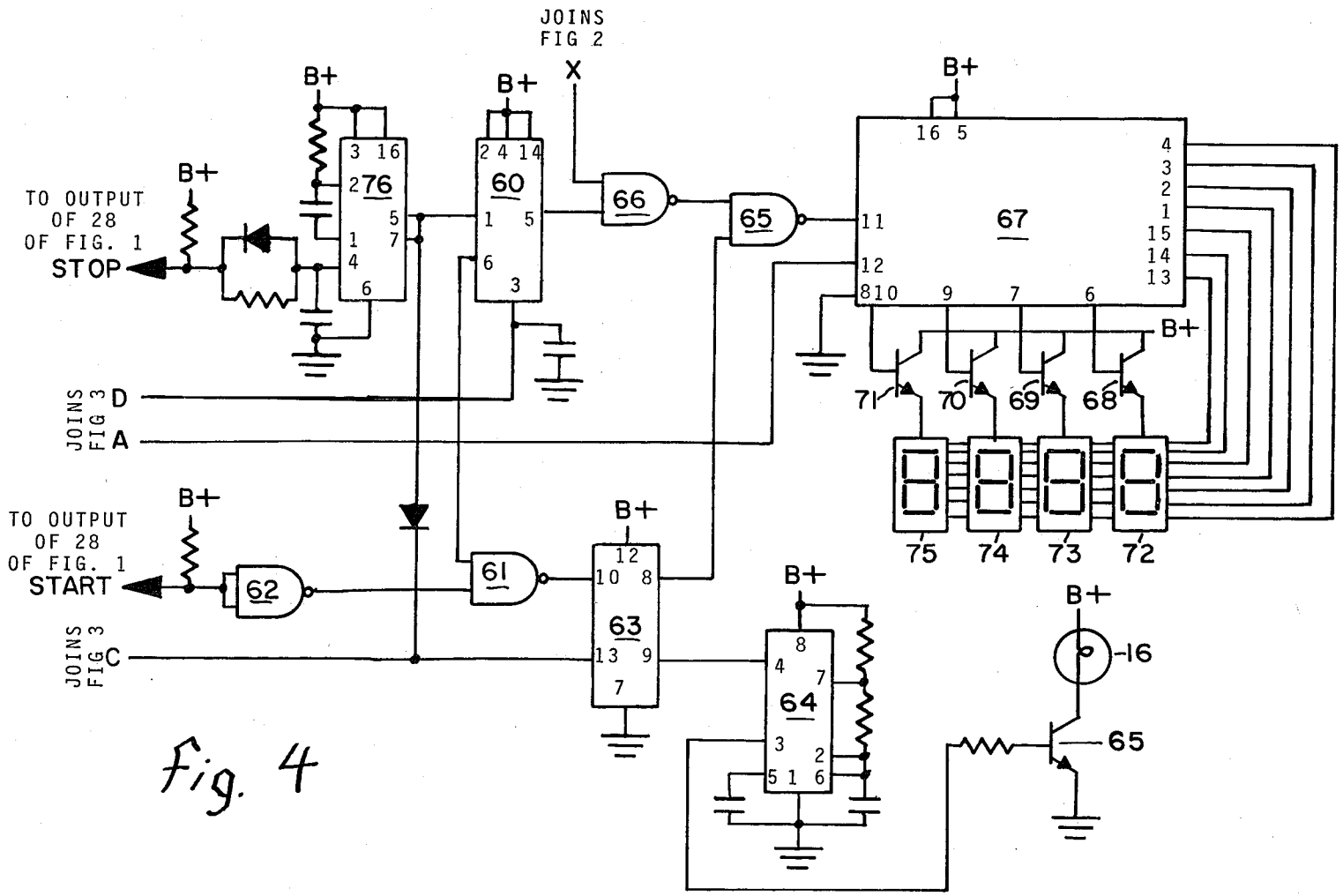
FIG. 4 is a schematic diagram of the time indicating circuit and foul circuit.

The preferred embodiment illustrated is capable of measuring time to 1 one hundredth of a second when utilizing a clock source such as the circuit of FIG. 2 which produces a 100 HZ pulse train that is applied to the counting circuit of FIG. 4.

Figure 3:
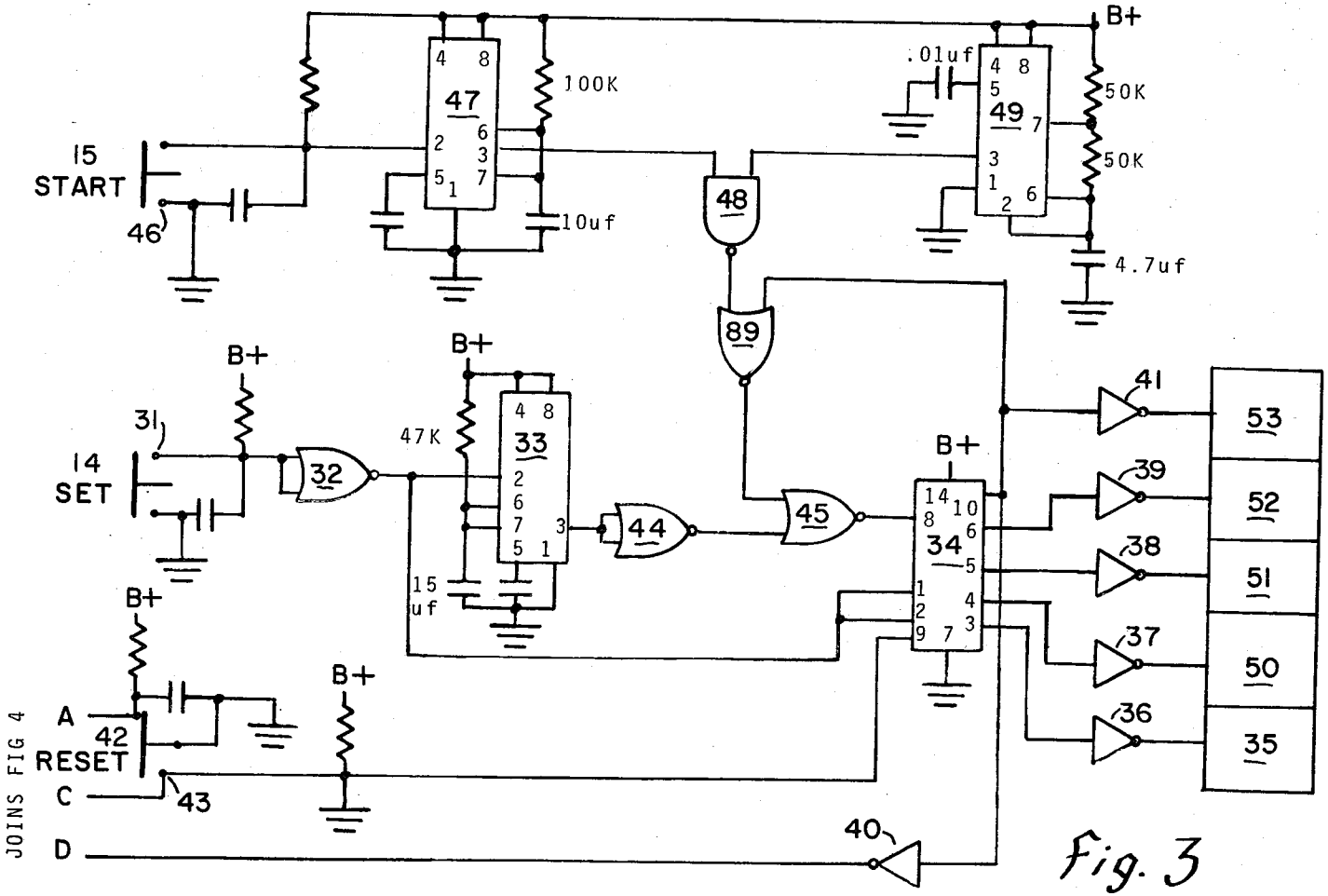
FIG. 3 is a schematic diagram of the start indicator circuit.

When the set button 14 of FIG. 1 is depressed, it closes the normally open push-button switch 31 of FIG. 3. This grounds both inputs of NOR gate 32 causing its output to transition from a low to a high. This transition is applied to the trigger input pin 2 of timer 33 which is a type 555 adapted to function as a one shot multivibrator generating a two second pulse.

The low to high transition output of NOR gate 32 is also applied to the serial inputs 1 and 2 of the 8-bit shift register 34. This causes the shift register to enter a high state and energize the ready lamp 35 via buffer amplifier 36. Buffer amplifiers 36 through 41 may be a type 75492 integrated circuit in a preferred embodiment.

If reset button 42 of FIGS. 1 and 3 is depressed, it causes switch 43 to place a ground potential at the pin 9 clear input to shift register 34. This negative transition at the clear input will clear the contents of the register and all of the lamps driven by register 34 will be extinguished. If set button 14 is depressed, register 34 will enter a high state as previously discussed and the ready lamp will become illuminated due to the low to high transition of NOR gate 32. The low to high transition of NOR gate 32 causes timer 33 to produce a two second pulse as previously discussed. This pulse is applied to both inputs of NOR gate 44 which functions as an inverter to apply a two second low pulse to one input of NOR gate 45.

The two second low pulse at one input of NOR gate 45 functions as an enabling pulse. If, while this enabling pulse is present, the start push-button 15 is depressed, the normally open switch 46 will ground the pin 2 trigger input of timer 47. Timer 47 is a type 555 integrated circuit timer configured to function as a one shot multivibrator which produces a three second positive pulse at output pin 3 commencing when the pin 2 input transitions to a low.

The positive three second enabling pulse produced by timer 47 is applied to one input of NAND gate 48. The second input to NAND gate 48 is provided by free running clock 49 which is a type 555 integrated circuit timer configured to function as a free running multivibrator producing clock pulses having a repetition frequency of two cycles per second. The two cycle per second pulses coupled from the output of 49 cause NAND gate 48 to produce low output pulses at a frequency of two cycles per second as long as the three second enabling pulse from timer 47 is applied to the other input of NAND gate 48. The negative two CPS pulses from NAND gate 48 are applied to one input of NOR gate 89 which receives a low output at its other input from the pin 10 output of shift register 34. The pin 10 output of shift register 34 remains low until the final lamp on the lamp starting tree is illuminated by the shifting action of the register placing a high at pin 10. This disables NOR gate 89 and no further counting action occurs.

The normal sequence of operation of the starting lamp circuit of FIG. 3 is as follows: set button 14 is depressed lowering both inputs to NOR gate 32 to ground via switch 31. This causes the output of NOR gate 32 to go high. The low to high transition at the pin 2 input of timer 33 has no effect on that circuit but it does clear shift register 34 via serial inputs pins 1 and 2 of that integrated circuit. When the set button 14 is released, the output of NOR gate 32 transitions from high to low and causes timer 33 to produce a two second positive output pulse at the input of NOR gate 44. This produces a two second negative enabling pulse at one input to NOR gate 45. When the start button 15 is now depressed, normally open switch 46 is closed and the high to low transition at input trigger pin 2 of timer 47 creates a positive three second enabling pulse at one input of NAND gate 48 so that the two CPS output of clock 49 may be applied as a negative pulse train to one input of NOR gate 89. NOR gate 89 at this time is receiving a low from shift register 34 because the shift register has been set to a high input state by the low to high transition of the output of NOR gate 32 as previously discussed. With the first negative output pulse of NAND gate 48, the output of NOR gate 89 goes high. This high is applied to one input of NOR gate 45 which has its other input held at a low state. The output of NOR gate 45 is therefore low and the conditions of the outputs of shift register 34 are, pin 3 high causing ready lamp indicator 35 to be illuminated. After the first clock pulse from 49 transitions from high to low, the output of NAND gate 48 transitions from low to high which causes the output of NOR gate 89 to transfer from high to low. Both inputs of NOR gate 45 are now low and its output is driven high. The negative to positive or low to high transition of the output of NOR gate 45 is applied to the clock input pin 8 of shift register 34 and causes the high at pin 3 to be shifted to pin 4 thus extinguishing the ready lamp 35 and illuminating the first lamp 50 of the start indicator light tree. In response to each clock pulse from free running multivibrator 49, shift register 34 is incremented so at the next pulse, the output at pin 4 of shift register 34 goes to 0 while pin 5 goes high to illuminate lamp 51 as lamp 50 is extinguished. The next pulse from 49 causes lamp 51 to be extinguished while lamp 52 is illuminated and the following pulse from free running multivibrator 49 causes lamp 52 to be extinguished and the final, start indicator lamp 53 to be illuminated by the high at pin 10. The high at pin 10 is also applied to one input of NOR gate 49 to disable that gate as previously indicated so that the counter 34 will not be further incremented. The high output at pin 10 is also coupled via inverter 40 to the pin 3 clock input of flip-flop 60 which is a type 7474 dual D edge-triggered flip-flop. In its quiescent state, the pin 5 to the output is low and the $\overline{Q}$ is high at pin 6. The high output at pin 6 of flip-flop 60 enables NAND gate 61 so that if a container 23 or 24 of FIG. 1 is lifted from its associated stand, the resulting low input to NAND gate 62 will cause its output to go high. This creates a high at the second input to NAND gate 61 and a low is applied to the pin 10 set input of flip-flop 63 which is a dual D edge-triggered flip-flop type 7474. This causes the Q output at pin 9 to go high which activates timer 64 via reset input 4. Timer 64 is a type 555 timer configured to function as a free running multivibrator having a frequency of one cycle per second. The one cycle per second positive pulses produced at the pin 3 output of free running multivibrator 64 cause transistor 65 to conduct. Transistor 65 is a 2N2222 type transistor in a preferred embodiment and it energizes the no chug or foul lamp 16 to indicate one of the containers has been removed from a beverage container stand before the Christmas tree starting lamp sequence has been completed.

In the event of a false start or foul, the reset pushbutton 42 must be depressed. This causes the normally open contact of switch 43 of FIG. 3 to be grounded which places a low potential at the clear input pin 13 of flip-flop 63. This causes the Q output at pin 9 to go low and extinguish foul indicator 16 and also causes the $\overline{Q}$ output at pin 8 to go high. This high is applied to one input of NAND gate 65 where it serves as an enabling potential for that gate.

When the Christmas tree start lamp sequences through lamps 50 through 53 and lamp 53 becomes illuminated, the high at pin 10 of shift register 34 is inverted by inverter 40 and applied to the pin 3 clock input of flip-flop 60. This causes the pin 5 Q output to go high and enable NAND gate 66. The master clock of FIG. 2 which generates a 100 HZ pulse train is connected to the second input to NAND gate 66 so that when enabled by flip-flop 60, a negative pulse will be produced by NAND gate 66 for each positive pulse of the master clock from FIG. 2. The negative pulse is applied to one input of NAND gate 65 which has its other input held at a high level providing a foul has not been created. Thus when the output of NAND gate 66 transitions from a low to a high as the master clock transitions from a high to a low, both inputs to NAND gate 65 will become high and its output will go low to increment shift register 67 which is a type 74C925 shift register adapted to drive four type IEE1703R indicators via direct coupling and transistors 68 through 71 which are type 2N2222 transistors.

With each incrementing negative pulse applied to pin 11 of shift register 67, the four indicators 72 through 75 are effected to present a digital incrementing display changing at a rate equal to the master clock frequency.

When one of the containers 23 or 24 is placed on a beverage container stand, the light beam between light emitting diode 26 and photoresponsive transistor 27 of FIG. 1 is interrupted. This causes the output of the associated amplifier 28 to go high. This causes flip-flop 76 of FIG. 4 to produce a low output at pin 7 which is applied to the pin 1 clear input of flip-flop 60 and the pin 13 clear input of flip-flop 63. This resets flip-flop 60 and causes its Q output at pin 5 to go low and inhibit NAND gate 66 so that the counter will cease counting. The low applied to pin 13 of flip-flop 63 will reset that flip-flop to enable NAND gate 65 but in view of NAND gate 66 being disabled, this will have no effect on the operation of the circuit. Diode 77 is incorporated between the clear input of flip-flop 63 and 60 so that reset pulses applied to clear a no chug light or foul light from reset switch 43 will not effect flip-flop 60.

Although many different integrated circuits may be utilized to perfect the invention, in the preferred embodiment illustrated the NAND gates are type 7400 and the NOR gates are type 7402's. Timers 33 and 47 are IC555 timers. Multivibrators 49 and 64 are type 555 timers. Flip-flops 60 and 63 are type 7474 integrated circuits. One-shot 76 is a type 9602 integrated circuit. Shift register 34 is a type 74164 integrated circuit and 4 digit counter 67 is a type 74C925 integrated circuit.

The 100 HZ timer of FIG. 2 may be any convenient 100 HZ source but in the preferred embodiment illustrated, it is comprised of a Motorola type MC14411 bit rate generator 80 with a 1.8432 Meg Hertz 81, controlling its frequency. The output frequency at pin 18 of bit rate generator 80 is reduced by a type 7490 decade counter 83 which is configured to function as a divide by two circuit having an output at pin 5 coupled to the base of transistor 84 to create the 100 HZ clock pulse.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A timing device, comprising:

first and second sensing means for providing signals indicative of the presence or absence of an object;

means for initiating a start sequence when enabled by signals from said first and second sensing means indicative of the presence of objects;

a start indicator responsive to an output of said means for initiating a start sequence; a start function generated by said start indicator;

a pulse generator for producing clock pulses; counting means activated by said start function for counting said clock pulses; and means responsive to said first or second sensing means providing a signal indicative of the presence of an object for stopping said counting means.

2. A timing device as defined in claim 1, comprising: inhibiting means responsive to said sensing means providing a signal indicative of the absence of an object for preventing said counting means from counting said clock pulses when said absence indicating signal occurs before said start function.

3. A timing device as defined in claim 2, comprising: a digital indicator means for displaying the accumulation by said counting means.

4. A timing device as defined in claim 3, comprising: a foul indicating means responsive to said inhibiting means for providing a visual indication of the operation of said inhibiting means.

5. A timing device as defined in claim 4, further comprising reset means to manually deactivate said inhibiting means.

6. A timing device as defined in claim 5, wherein said start indicator comprises:

a shift register including a plurality of outputs;

indicator lamps for predetermined ones of said plurality of outputs of said shift register; and logic means responsive to said means for initiating a start sequence for incrementing said shift register.

7. A timing device as defined in claim 6, wherein said logic means comprises:

a two input logic gate;

a one shot multivibrator responsive to said means for initiating a start sequence for enabling said two input logic gate; and a pulse generator for generating incrementing pulses to be applied through said logic gate when said logic gate is enabled.

8. A timing device as defined in claim 7, comprising:

a second logic gate means interposed between said logic means and said shift register;

a timing pulse generator for enabling said second logic gate means; and switch means for activating said timing pulse generator.

9. A timing device as defined in claim 8, further comprising reset switch means for resetting said shift register.

10. A timing device as defined in claim 9, wherein said digital indicator means comprises:

a plurality of digital indicators;

a flip-flop responsive to a predetermined output of said shift register for providing an enabling logic function;

a counter logic gate enabled by said enabling function of said flip-flop for passing said clock pulses when enabled; and a counter shift register incremented by the output of said counter logic gate for controlling said digital indicators.

11. A timing device as defined in claim 10, wherein said sensing means comprises a light source and a light responsive means oriented so that it is illuminated by said light source but positioned apart therefrom so that said object may shield said light responsive means from said light source.

* * * * *